US009042772B2

(12) United States Patent
Mori

(10) Patent No.: US 9,042,772 B2
(45) Date of Patent: May 26, 2015

(54) IMAGE FORMING APPARATUS

(71) Applicant: Shogo Mori, Nagoya (JP)

(72) Inventor: Shogo Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 90 days.

(21) Appl. No.: 13/784,946

(22) Filed: Mar. 5, 2013

(65) Prior Publication Data

US 2013/0259517 A1 Oct. 3, 2013

(30) Foreign Application Priority Data

Mar. 29, 2012 (JP) ..... 2012-077644

(51) Int. Cl.
*G03G 15/00* (2006.01)
*G03G 21/16* (2006.01)

(52) U.S. Cl.
CPC ..... *G03G 21/1666* (2013.01); *G03G 21/1633* (2013.01); *G03G 21/1647* (2013.01)

(58) Field of Classification Search
CPC ..... G03G 21/1666; G03G 21/1647; G03G 21/1633
USPC ..... 399/110, 118, 205, 125
See application file for complete search history.

(56) References Cited

U.S. PATENT DOCUMENTS 6,434,350 B2 8/2002 Kikuchi et al.
7,131,511 B2 11/2006 Arnold
7,302,221 B2 11/2007 Shyu
7,388,593 B2 6/2008 Fukuda
7,656,421 B2 2/2010 Itabashi
7,822,362 B2 10/2010 Watanabe et al.
7,826,769 B2 11/2010 Yamaguchi
7,840,159 B2 11/2010 Nakashima
7,853,176 B2 12/2010 Itabashi
7,957,666 B2 6/2011 Sato et al.
7,962,061 B2 6/2011 Sato et al.

(Continued)

FOREIGN PATENT DOCUMENTS

JP 05-035003 A 2/1993
JP 05-281795 A 10/1993

(Continued)

OTHER PUBLICATIONS

Notification of Reasons for Refusal issued in corresponding Japanese Patent Application No. 2008-098289 dated May 11, 2010.

(Continued)

*Primary Examiner* — David Gray
*Assistant Examiner* — Sevan A Aydin
(74) *Attorney, Agent, or Firm* — Banner & Witcoff, Ltd.

(57) ABSTRACT

An image forming apparatus includes: a body frame having an opening; a cover configured to open/close the opening; an exposure unit configured to expose a photosensitive member and being swingable between an exposure position and a retreated position; an urging member configured to urge the exposure unit from the exposure position towards the retreated position; and an interlocking mechanism configured to: swing the exposure unit from the retreated position to the exposure position against an urging force of the urging member in conjunction with the rotation of the cover when the cover is closed; and allow the exposure unit to swing from the exposure position to the retreated position by the urging force of the urging member in conjunction with the rotation of the cover when the cover is opened.

20 Claims, 8 Drawing Sheets

(56) References Cited

U.S. PATENT DOCUMENTS

| | | | | |
|---|---|---|---|---|
| 7,991,325 | B2 * | 8/2011 | Yamaguchi | 399/125 |
| 8,126,356 | B2 * | 2/2012 | Watanabe et al. | 399/110 |
| 8,208,834 | B2 * | 6/2012 | Yamaguchi | 399/125 |
| 8,238,764 | B2 * | 8/2012 | Funahashi | 399/12 |
| 2001/0021321 | A1 | 9/2001 | Kikuchi et al. | |
| 2005/0284680 | A1 | 12/2005 | Arnold | |
| 2009/0087209 | A1 | 4/2009 | Yamaguchi | |
| 2009/0116875 | A1 * | 5/2009 | Sugiyama et al. | 399/177 |
| 2009/0214258 | A1 * | 8/2009 | Yamaguchi | 399/125 |
| 2009/0252528 | A1 | 10/2009 | Yamaguchi | |
| 2010/0053585 | A1 * | 3/2010 | Yokoi et al. | 355/72 |
| 2012/0051800 | A1 | 3/2012 | Yamazaki et al. | |
| 2012/0275819 | A1 * | 11/2012 | Mori et al. | 399/110 |
| 2013/0259515 | A1 * | 10/2013 | Mori | 399/107 |
| 2014/0056612 | A1 * | 2/2014 | Mori | 399/110 |

FOREIGN PATENT DOCUMENTS

| | | | |
|---|---|---|---|
| JP | 2001-255803 | A | 9/2001 |
| JP | 2003-112446 | A | 4/2003 |
| JP | 2006-008127 | A | 1/2006 |
| JP | 2007-065125 | A | 3/2007 |
| JP | 2009-251231 | A | 10/2009 |

OTHER PUBLICATIONS

Mar. 3, 2015—(CN) The First Office Action—App 201310090775.8, Eng Tran.

* cited by examiner

IMAGE FORMING APPARATUS

CROSS-REFERENCE TO RELATED APPLICATIONS

This application claims priority from Japanese Patent Application No. 2012-077644 filed on Mar. 29, 2012, the entire subject matter of which is incorporated herein by reference.

TECHNICAL FIELD

The invention relates to an image forming apparatus including an exposure unit having a plurality of blinking parts provided at a tip portion thereof.

BACKGROUND

There have been known an image forming apparatus including a body frame having an opening, a cover opening and closing the opening and an LED unit (exposure unit) rotatably supported to the cover. Specifically, this related-art structure has an interlocking mechanism for swinging the LED unit in conjunction with an opening/closing operation of the cover such that: when the cover is closed, the LED unit is located at a position at which the LED unit is able to expose a photosensitive member; and when the cover is opened, the LED unit is located at a retreated position at which the LED unit is more folded towards the cover than at the exposure position when the cover is opened.

Further, the interlocking mechanism is provided with a coil spring for urging the LED unit from the retreated position towards the exposure position. Thereby, when closing the cover, the LED unit is adapted to swing from the retreated position to the exposure position by an urging force of the coil spring, and when opening the cover, the LED unit is adapted to swing from the exposure position to the retreated position against the urging force of the coil spring. That is, since the urging force of the coil spring is set to be stronger at the time of opening of the cover than at the time of closing of the cover, it is possible to suppress the LED unit from swinging at the time of opening of the cover by the urging force.

SUMMARY

However, when the urging force of the coil spring is set to be stronger at the time of opening of the cover than at the time of closing of the cover, the urging force of the coil spring is weakened as the cover is being closed, so that the LED unit is apt to swing. Thus, for example, when the cover is vigorously closed, the LED unit largely swings and may interfere with a cartridge. Hence, the above-described related art has a swing restraint mechanism for restraining the swinging of the LED unit when closing the cover so as to suppress the LED unit from largely swinging.

However, according to the above-described related art, since the swing restraint mechanism for restraining the swinging of the LED unit is provided to the cover, a structure of the cover is complicated and the cover is weighted.

Therefore, illustrative aspects of the invention provide an image forming apparatus capable of simplifying/lightening a cover.

According to one illustrative aspect of the invention, there is provided an image forming apparatus comprising: a body frame having an opening; a cover provided to the body frame and configured to swing between an open position at which the opening is opened and a close position at which the opening is closed; an exposure unit comprising a plurality of blinking parts and configured to expose a photosensitive member, wherein the exposure unit is rotatably supported to the cover and is configured to swing between an exposure position at which the exposure unit is able to expose the photosensitive member and a retreated position at which the exposure unit is folded towards the cover than at the exposure position; an urging member configured to urge the exposure unit from the exposure position towards the retreated position; and an interlocking mechanism. The interlocking mechanism is configured to: swing the exposure unit from the retreated position to the exposure position against an urging force of the urging member in conjunction with the rotation of the cover when the cover is closed; and allow the exposure unit to swing from the exposure position to the retreated position by the urging force of the urging member in conjunction with the rotation of the cover when the cover is opened.

According to this configuration, even when the cover is vigorously closed, the interlocking mechanism swings the exposure unit against the urging force of the urging member, so that the urging force of the urging member becomes strong. Therefore, it is possible to suppress the exposure unit from largely swinging by the strong urging force. Further, since the exposure unit is suppressed from excessively swinging by the strong urging force of the urging member, the swing restraint member of the related art is not necessary. Therefore, it is possible to simplify/lighten the cover.

According to another illustrative aspect of the invention, the cover comprises an abutting part configured to abut on the exposure unit or interlocking mechanism when the exposure unit is located at the retreated position. The urging member is configured to be deformed at a state where the exposure unit or interlocking mechanism abuts on the abutting part.

According to this configuration, when the exposure unit is located at the retreated position, the exposure unit or interlocking mechanism is urged towards the abutting part by the deformed urging member. Therefore, it is possible to suppress the exposure unit from swinging at the retreated position, compared to a configuration where the abutting part is not provided and the exposure unit is supported by an urging member having a natural length (a state where the urging member is not deformed) at the retreated position, for example.

According to still another illustrative aspect of the invention, the exposure unit is configured to be rotatable with respect to the cover around a rotation axis and comprises the plurality of blinking parts at a first part thereof. The interlocking mechanism comprises: a connection member that is configured to move along the cover and is rotatably connected to a second part, which is located across the rotation axis from the first part, of the exposure unit; a rotating member that is configured to be rotatable with respect to the cover around a rotating center and comprises a first portion deviating from the rotating center and connected to the connection member; and a moving member that is configured to move along the cover and is configured to press a second portion of the rotating member deviating from the rotation center. The moving member is configured to move in conjunction with the opening/closing operation of the cover.

According to still another illustrative aspect of the invention, the moving member comprises: a support surface following a moving direction of the moving member; and a pressing surface that is inclined relative to the support surface. The moving member is configured to: press the second portion by the pressing surface when the cover is gradually closed from the open position; and support the second portion by the support surface so as to restrain the moving of the second portion by the urging force when the cover is located at the close position.

According to still another illustrative aspect of the invention, the urging member is a tension spring.

According to still another illustrative aspect of the invention, the moving member is configured to move towards a tip of the cover in conjunction with the closing operation of the cover. The urging member is provided at the tip of the cover.

According to still another illustrative aspect of the invention, the image forming apparatus further comprises a plurality of the exposure units.

According to still another illustrative aspect of invention, the moving member is configured to move in a first direction and to press the second portion of the rotating member. Upon the second portion of the rotating member being pressed in the first direction, the rotating member is configured to rotate so as to move the connection member in a second direction that is opposite to the first direction. Upon the connection member moving the second direction, the second part of the exposure unit is configured to move in the second direction together with the connection member. The exposure unit is configured to swing around the rotation axis so as to swing between the exposure position and the retreated position by moving the second part of the exposure unit. Upon the second part of the exposure unit moving in the second direction, the exposure unit is configured to swing to the exposure portion from the retreated position.

According to still another illustrative aspect of the invention, the urging member has a first length that is longer than a natural length at the state where the exposure unit or interlocking mechanism abuts on the abutting part.

According to still another illustrative aspect of the invention, the urging member has a second length that is longer than the first length at a state where the exposure unit is in the exposure position.

According to the illustrative aspects of the invention, it is possible to simplify/lighten the cover.

BRIEF DESCRIPTION OF THE DRAWINGS

FIGS. 5A and 5B are side views showing a relation between the LED unit and an interlocking mechanism, in which FIG. 5A shows a state at an exposure position, and FIG. 5B shows a state at a retreated position;

DETAILED DESCRIPTION

Hereinafter, an exemplary embodiment of the invention will be specifically described with reference to the accompanying drawings. Incidentally, in the below descriptions, a schematic configuration of a color printer 1, which is an example of the image forming apparatus, will be briefly described and then a specific configuration will be described.

In the below descriptions, the directions are described on the basis of a user who uses the color printer 1. That is, the left of FIG. 1 is referred to as the 'front,' the right of FIG. 1 is referred to as the 'rear,' the inner side of FIG. 1 is referred to as the 'left' and the front side of FIG. 1 is referred to as the 'right.' Also, the upper and lower directions of FIG. 1 are referred to as the 'upper-lower.'

<Schematic Configuration of Color Printer>

Figure 1:
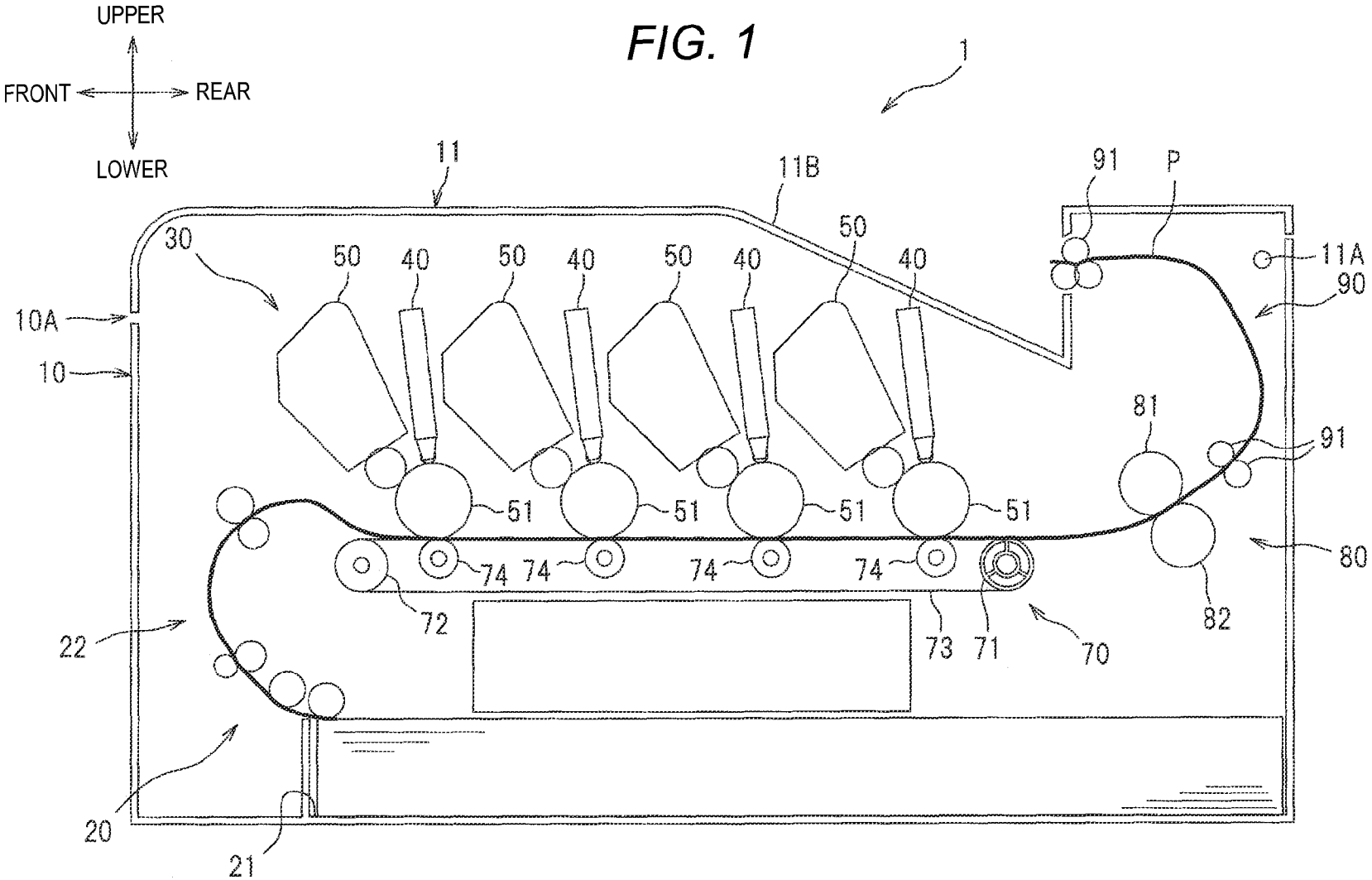
FIG. 1 shows a schematic configuration of a color printer that is an example of the image forming apparatus according to an exemplary embodiment of the invention.

As shown in FIG. 1, the color printer 1 includes a body frame 10, a top cover 11 that is an example of the cover and a feeder unit 20 and an image forming unit 30 that are provided in the body frame 100.

Figure 2:
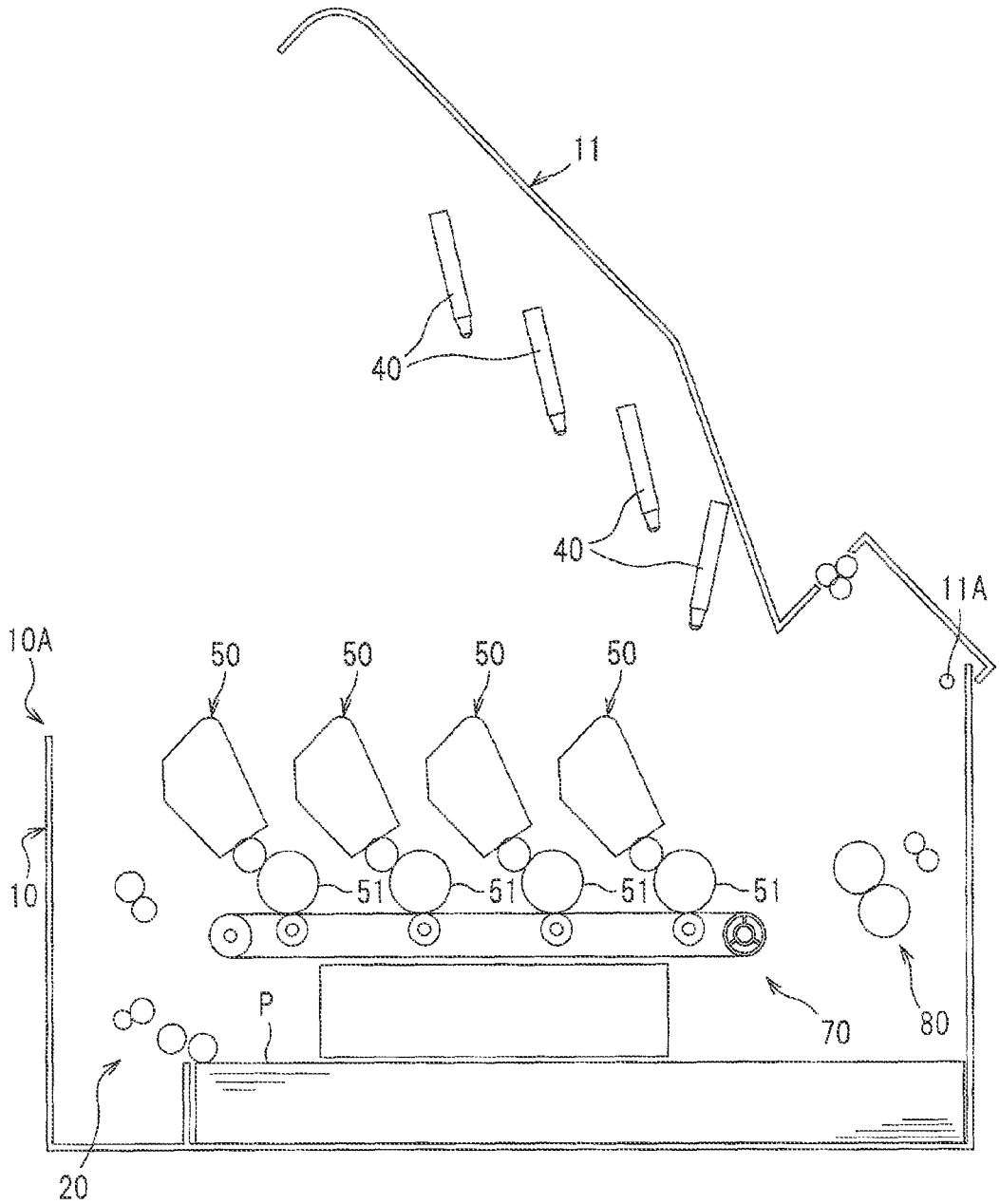
FIG. 2 shows the color printer at a state where a top cover is opened.

The top cover 11 is arranged at the upper of the body frame 10 and is configured to rotate relative to the body frame 10 about a rear rotation axis 11A. The top cover 11 is configured to open/close an opening 10A that is formed at the upper of the body frame 10. Specifically, the top cover 11 is configured to swing between a close position at which the opening 10A is closed (refer to FIG. 1) and an open position at which the opening 10A is opened (refer to FIG. 2).

The feeder unit 20 is provided at the lower in the body frame 10. The feeder unit 20 includes a sheet feeding tray 21 configured to accommodate therein sheets P and a sheet feeding mechanism 22 configured to feed the sheets P from the sheet feeding tray 21 to the image forming unit 30. The sheets P in the sheet feeding tray 21 are separated and fed one at a time to the image forming unit 30 by the sheet feeding mechanism 22.

The image forming unit 30 includes four LED units 40, which are an example of a plurality of exposure units, four process cartridges 50, a transfer unit 70 and a fixing unit 80.

The LED unit 40 has a plurality of LEDs at a tip thereof. The LED unit 40 is held at the top cover 11 (specifically, holder 300 (which will be described later)) as if it were hung from the top cover 11. The LED unit 40 is arranged to face the upper of a photosensitive drum 51 (which will be described later) when the top cover 11 is closed. The LED unit 40 is configured to expose a surface of the photosensitive drum 51 as the LEDs blink based on image data. Incidentally, the structure of the exposure unit 40 will be specifically described later.

The respective process cartridges 50 are parallel arranged in the front-rear direction between the top cover 11 and the sheet feeding tray 21. Each process cartridge 50 is removably mounted through the opening 10A of the body frame 10 at a state where the top cover 11 is opened (refer to FIG. 2). Each process cartridge 50 includes the photosensitive drum 51, which is an example of the photosensitive member, a charger (not shown) and a well-known developing roller, a toner accommodation chamber and the like (the reference numerals thereof are omitted).

The transfer unit 70 is provided between the sheet feeding tray 21 and the process cartridges 50. The transfer unit 70 includes a driving roller 71, a driven roller 72, an endless conveyance belt 73 that is provided in a tensioned state between the driving roller 71 and the driven roller 72 and four transfer rollers 74. The conveyance belt 73 has an outer surface that abuts on the respective photosensitive drums 51, and the respective transfer rollers 74 are arranged to sandwich the conveyance belt 73 at an inside of the belt between the transfer rollers and the photosensitive drums 51.

The fixing unit 80 is provided at the rear of the process cartridges 50 and the transfer unit 70. The fixing unit 80 includes a heating roller 81 and a pressing roller 82 that is arranged to face the heating roller 81 and is configured to press the heating roller 81.

In the image forming unit 30, the surfaces of the photosensitive drums 51 are uniformly charged by the chargers and then exposed by the LED units 40, so that electrostatic latent images based on image data are formed on the photosensitive drums 51. Then, the toner is supplied from the developing rollers to the photosensitive drums 51, so that the electrostatic latent images become visible and toner images are thus formed on the photosensitive drums 51.

As the sheet P conveyed from the feeder unit 20 is conveyed between the photosensitive drums 51 and the conveyance belt 73 (transfer rollers 74), the toner images formed on the respective photosensitive drums 51 are sequentially transferred with being overlapped onto the sheet P. The sheet P having the toner images transferred thereto is conveyed between the heating roller 81 and the pressing roller 82, so that the toner images are heat-fixed. After that, the sheet P is discharged to the outside from the body frame 10 by conveyance rollers 91 and is put on a sheet discharge tray 1113 that is formed on an upper surface of the top cover 11.

<Structure Around LED Unit>

In the below, a structure around the LED unit 40 will be specifically described.

Figure 3:
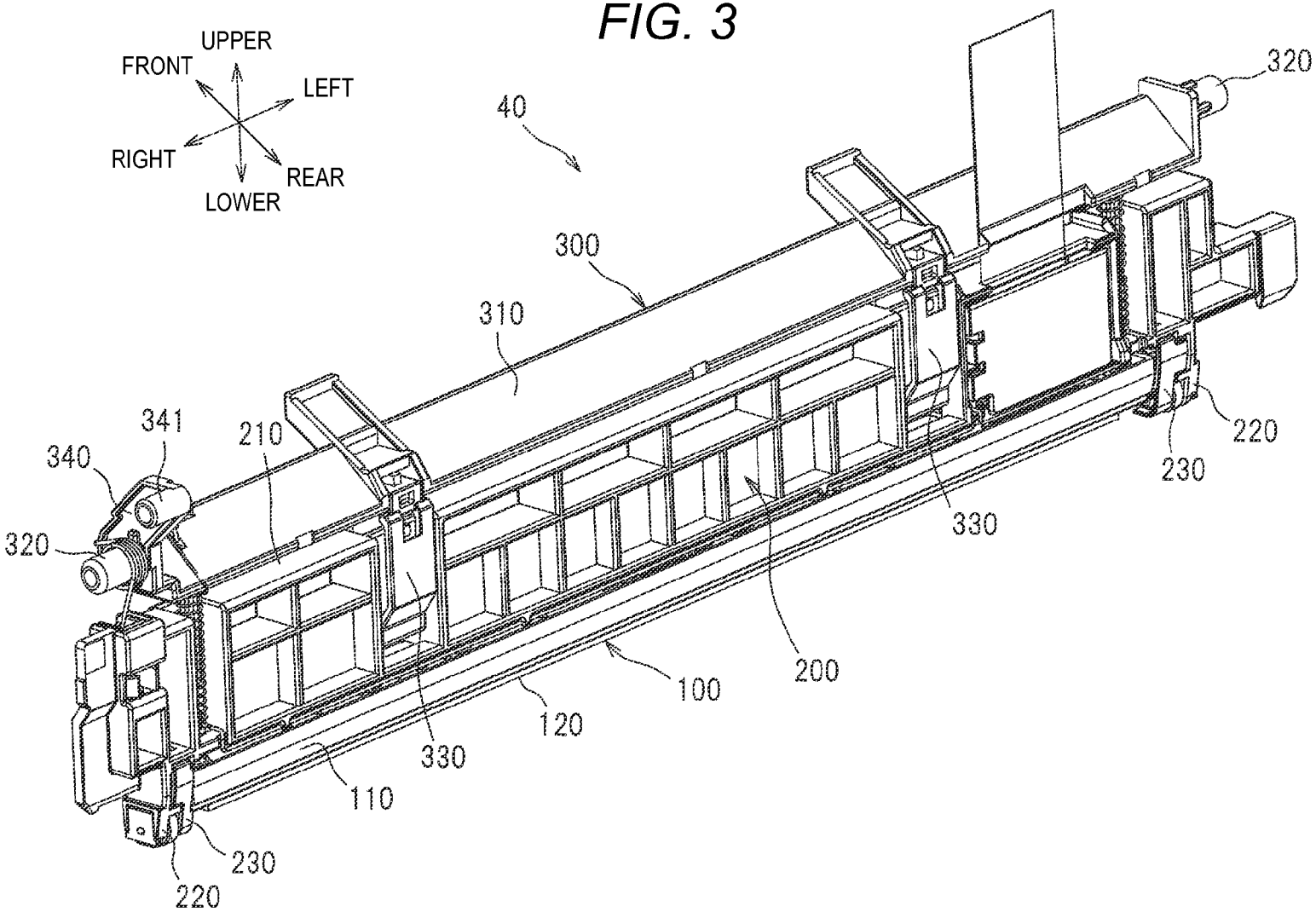
FIG. 3 is a perspective view showing a state where an LED unit and a holder are mounted.

As shown in FIG. 3, the LED unit 40 includes an LED head 100 having a long shape, a resin support frame 200 configured to support the LED head 100 and a resin holder 300.

(LED Head 100)

The LED head 100 includes: a resin holding case 110; a plurality of LED arrays (not shown) that is provided in the holding case 110 and is configured by a plurality of LEDs arranged in line in the left-right direction on a semiconductor chip; and a lens array 120 that is disposed below the LED arrays and is held by the holding case 110. Incidentally, in this exemplary embodiment, the plurality of blinking parts is configured by the plurality of LED arrays and the lens array 120.

(Support Frame 200)

The support frame 200 includes a base part 210 that extends in the left-right direction and a pair of extension parts 220 that extends downwards from both end portions of the base part 210 in the left-right direction (longitudinal direction).

The base part 210 is held in the front-rear direction by a pair of front and rear holding arms 33 (only the rear holding arm 330 is shown) that is arranged at the left and right sides of the holder 300, so that the base part 210 is supported by the holding arms 330 as if it were hung down.

The pair of extension parts 220 is configured to support both end portions of the LED head 100 via support auxiliary members 230. Specifically, each extension part 220 is configured to sandwich and support the end portion of the LED head 100 and a spring-shaped portion (not shown) of the support auxiliary member 230 in the upper-lower direction between the base part 210 and the extension part 220.

(Holder 300)

Figure 4:
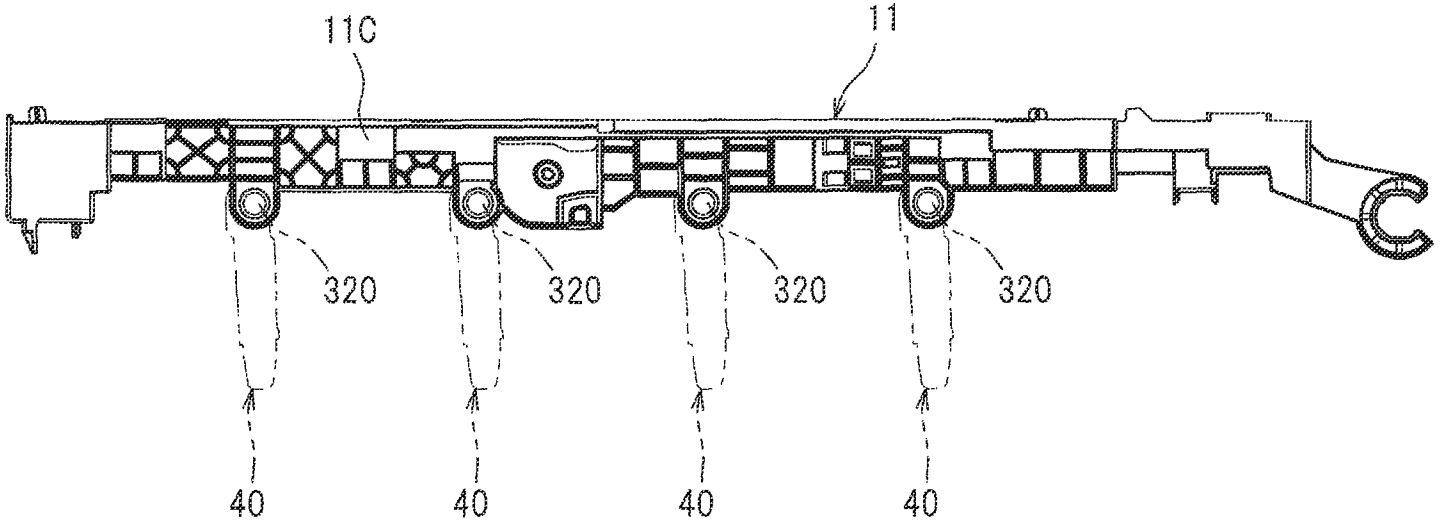
FIG. 4 is a side view showing a holder support member of the top cover.

The holder 300 includes: a body part 310 having a long shape extending in the left-right direction; a pair of left and right rotation axes 320 that extends outwards from both left and right end portions of the body part 310 in the left-right direction; and the holding arms 330. As shown in FIG. 4, the left and right rotation axes 320 are rotatably supported to a pair of left and right holder support members 11C that is provided at left and right end portions of the top cover 11.

Figure 5A:
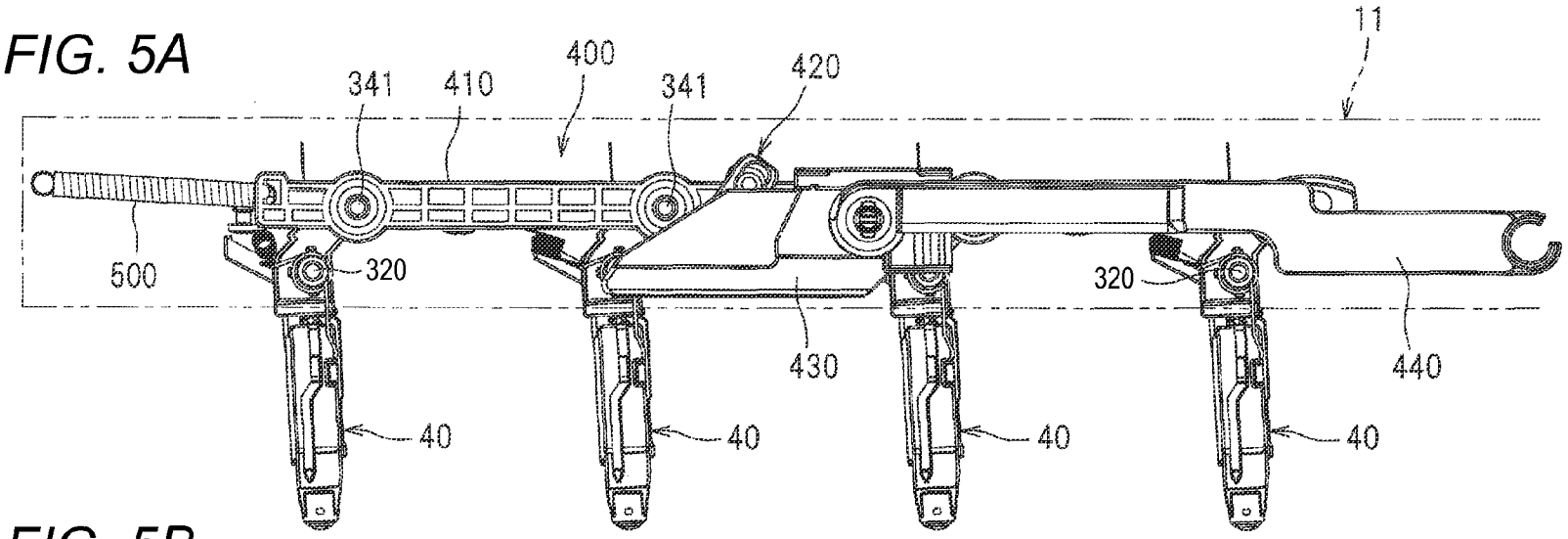
Figure 5B:
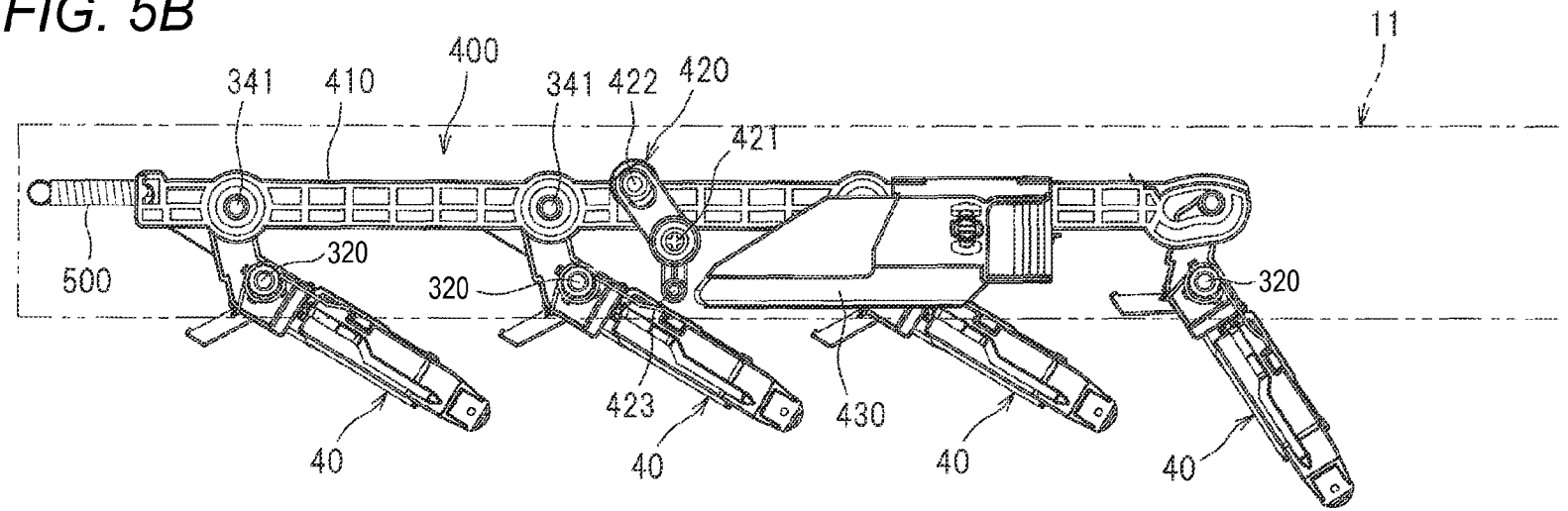

Thereby, the LED unit 40 is configured to swing between an exposure position (refer to FIG. 5A) at which the LED unit can expose the photosensitive drum 51 and a retreated position (refer to FIG. 5B) at which the LED unit is folded towards the top cover 11 than at the exposure position.

As shown in FIG. 3, the right end portion of the holder 300 (body part 310) is formed with an extension part 340 that extends obliquely in the rear-upper direction. A tip of the extension part 340 is formed with a cylindrical connection protrusion 341. In other words, the connection protrusion 341 is provided at a part that is located across the rotation axis 320 from the LED head 100 of the LED unit 40.

The connection protrusion 341 is moved in a direction (the front-rear direction when the top cover 11 is closed, hereinafter, simply referred to as 'front-rear direction') connecting the tip of the top cover 11 and the rotation axis 11A (refer to FIG. 1) by an interlocking mechanism 400 shown in FIGS. 5 to 8, so that the LED unit 40 swings between the exposure position and the retreated position.

(Interlocking Mechanism 400)

As shown in FIG. 5, the interlocking mechanism 400 includes a connection member having a long shape and a rotating member 420 and a moving member 430, which are provided at an outer side of the connection member 410 in the left-right direction.

The connection member 410 extends in the front-rear direction and the connection protrusions 341 of the respective LED units 40 are rotatably connected thereto. The connection member 410 is supported to the top cover 11 so that it can move in the front-rear direction. Incidentally, in FIG. 5, the top cover 11 is simply shown with the dashed-two dotted line for convenience.

The tip (front side) of the top cover 11 is provided with a tension spring 500 that is an example of the urging member and is configured to urge the connection member 410 to be always drawn towards the tip. Thereby, the respective LED units 40 are always urged from the exposure position towards the retreated position.

The rotating member 420 includes: a rotating center part 421; a first arm part 422 extending upwards from the rotating center part 421; and a second arm part 423 extending downwards from the rotating center part 421. The rotating center part 421 is rotatably supported to the top cover 11.

The first arm part 122 has a tip (a first portion deviating from the rotating center part 421) that is rotatably connected to the connection member 110. A tip (a second portion deviating from the rotating center part 421) of the second arm part 423 is configured to be pushed forward by the moving member 130 (which will be described later), so that the rotating member 420 is rotated in a shown clockwise direction and the connection member 410 is thus pushed rearward against the urging force of the tension spring 500 by the rotating member 420.

The moving member 430 is a member that is long in the front-rear direction and has a wedge shape, when from a side. The moving member 430 is supported to the top cover 11 so that it can move in the front-rear direction. The moving member 430 is provided with a pressing part 431 (refer to FIG. 8) at an inside of a front side part thereof (an acicular tip part) in the left-right direction.

The pressing part 431 is a part configured to press forward the tip of the second arm part 423 of the rotating member 420. The pressing part 432 includes a support surface 432 following a moving direction of the moving member 430 and a pressing surface 433 that is inclined relative to the support surface 432. Specifically, the pressing surface 433 is obliquely inclined from a front end of the support surface 432 in the front-lower direction.

Figure 6:
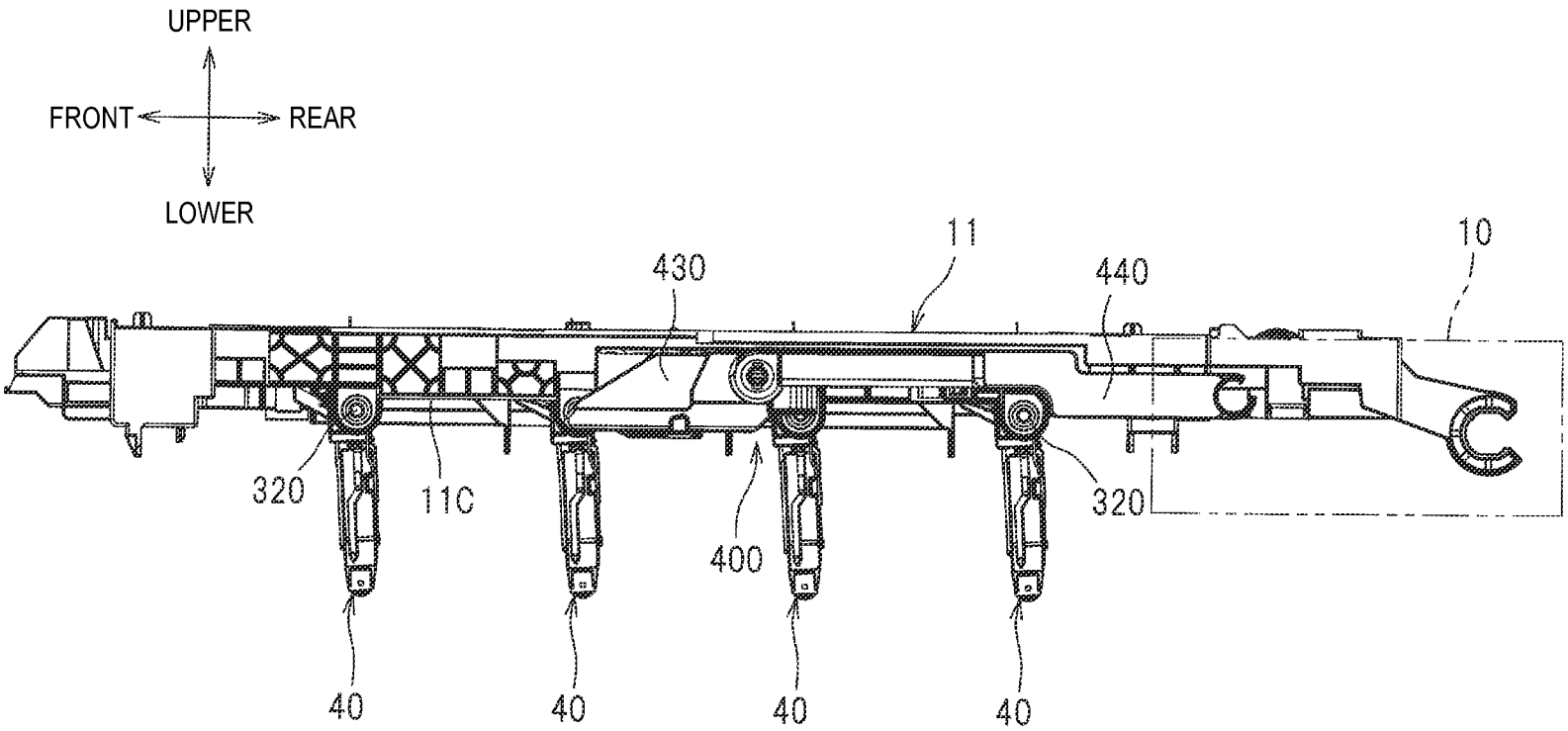
FIG. 6 is a side view showing a relation between the interlocking mechanism and a body frame at a close position.

As shown in FIGS. 6 and 7, a rear end portion of the moving member 430 is rotatably connected to a tip of the connection arm 440 that is swingably connected to the body frame 10. Thereby, the moving member 430 is configured to be moved forward and rearward in conjunction with the opening/closing operation of the top cover 11. Here, in FIGS. 6 and 7, a part of the body frame 10 is shown with the dashed-two dotted line for convenience.

Figure 8:
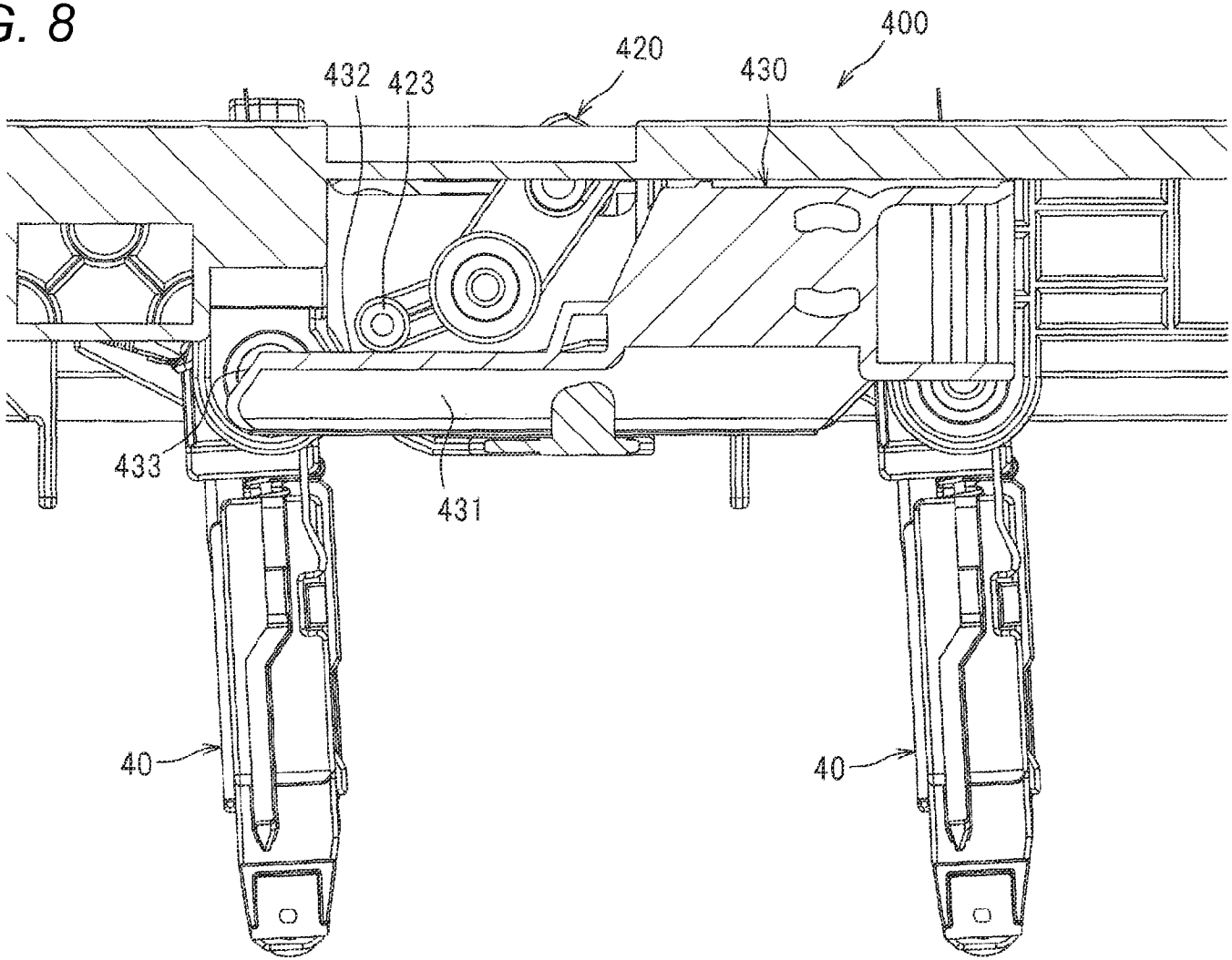
FIG. 8 is a sectional view showing a relation between moving member and a rotating member.

Specifically, when the top cover 11 is gradually closed from the open position, the moving member 430 is moved towards the tip of the top cover 11 to thus press forward the tip of the second arm part 423 of the rotating member 420 by the pressing surface 433 (refer to FIG. 8). Thereby, while the pressing surface 433 is engaged with the tip of the second arm part 423, the rotating member 420 is rotated in the shown clockwise direction, so that the connection member 410 is moved rearward against the urging force of the tension spring 500. Therefore, the LED units 40 swing towards the exposure position.

When the tip of the second arm part 423 deviates from the pressing surface 433 and is then supported by the support surface 432 while the top cover 11 is being closed (located near by the close position), the rotation of the rotating member 420 and the rearward moving of the connection member 410 are stopped, so that the LED units 40 (holders 300) become immobile relative to the top cover 11. After that, when the top cover 11 is rotated to the close position, the LED units 40 that are immobile relative to the top cover 11 are arranged at the exposure position.

Further, when the top cover 11 is gradually opened from the close position, the moving member 430 is moved towards the rotation axis 11A of the top cover 11. At this time, while the tip of the second arm part 423 of the rotating member 420 is supported by the support surface 432, the LED units 40 do not swing relative to the top cover 11. When the second arm part 423 deviates from the support surface 432, the LED units 40 swing towards the retreated position by the urging force of the tension spring 500.

That is, when the top cover 11 is closed, the interlocking mechanism 400 is moved in conjunction with the rotation of the top cover 11, thereby swinging the LED units 40 from the retreated position to the exposure position against the urging force of the tension spring 500. Further, when the top cover 11 is opened, the interlocking mechanism 400 is moved in conjunction with the rotation of the top cover 11, thereby allowing the LED units 40 to swing from the exposure position to the retreated position by the urging force of the tension spring 500.

Therefore, even when the top cover 11 is vigorously closed, the interlocking mechanism 400 swings the LED units 400 against the urging force of the tension spring 500, so that the urging force of the tension spring 500 becomes strong. Therefore, it is possible to suppress the LED units 40 from largely swinging by the strong urging force of the tension spring 500. Further, since the LED units 40 are suppressed from excessively swinging by the strong urging force of the tension spring 500, the swing restraint member of the related art is not necessary. Therefore, it is possible to simplify/lighten the top cover 11.

Figure 7A:
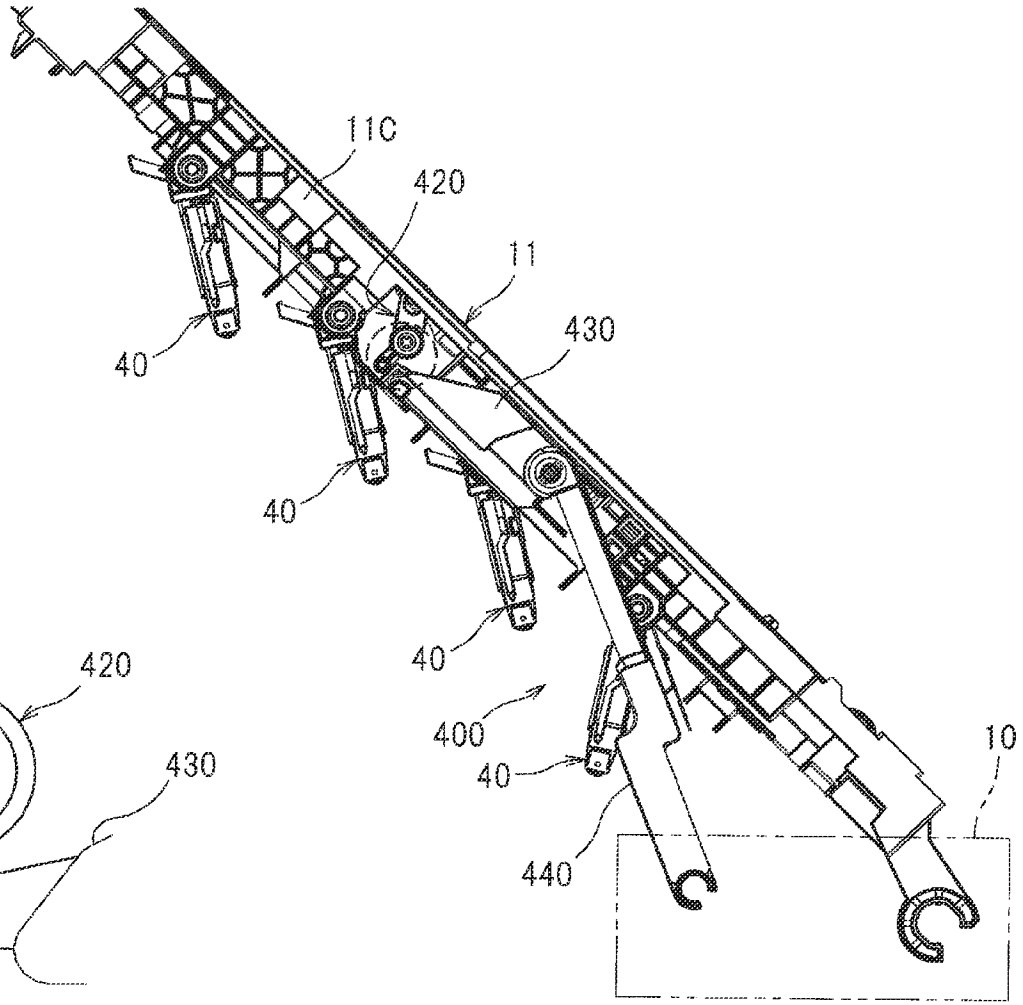
FIG. 7A is a side view showing a relation between the interlocking mechanism and the body frame at an open position.
Figure 7B:
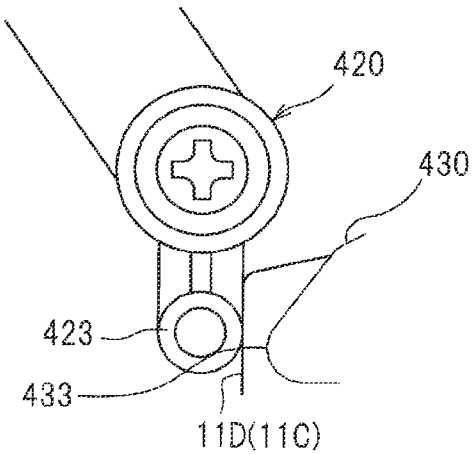
FIG. 7B is an enlarged view showing around an abutting part.

Further, as shown in FIGS. 7A and 7B, the holder support member 11C of the top cover 11 is provided with an abutting part 11D configured to abut on the tip (interlocking mechanism 400) of the second arm part 423 of the rotating member 420 when the LED units 40 are located at the retreated position. Specifically, the abutting part 11D is provided so that it is positioned at the front of the pressing surface 433 of the moving member 430 when the moving member 430 is moved most rearward (when the top cover 11 is located at the open position).

The tension spring 500 is configured such that it is slightly deformed (slightly pulled and stretched) at a state where the rotating member 420 abuts on the abutting part 11D. Thereby, when the LED units 40 are located at the retreated position, the rotating member 420 is urged towards the abutting part 11D by the deformed tension spring 500. Therefore, it is possible to suppress the LED units 40 from swinging at the retreated position, compared to a configuration where the abutting part is not provided and the LED units are supported by a tension spring having a natural length at the retreated position, for example.

According to the above exemplary embodiment, following effects can be obtained in addition to the above effects.

When the top cover 11 is located at the close position, the support surface 432 following the moving direction of the moving member 430 sustains the urging force of the tension spring 500. Therefore, it is possible to prevent the moving member 430 from moving due to the urging force. Further, since the swinging of the second arm part 423 of the rotating member 420 by the urging force is restrained, it is possible to securely suppress the LED units 40 (holders 300) from swinging at the close position.

Incidentally, the invention is not limited to the above-described exemplary embodiment and can be used in a variety of embodiments, as described below.

In the above-described exemplary embodiment, the interlocking mechanism 400 (rotating member 420) abuts on the abutting part 11D. However, the invention is not limited thereto. For example, the exposure unit may be configured to abut on the abutting part.

In the above-described exemplary embodiment, the photosensitive drum 51 has been exemplified as the photosensitive member. However, the invention is not limited thereto. For example, a belt-shaped photosensitive member may be also adopted.

In the above-described exemplary embodiment, the configuration having the plurality of LED arrays arranged in line in the left-right direction has been exemplified as the plurality of blinking parts. However, the invention is not limited thereto. For example, a configuration having a plurality of rows in the front-rear direction, each of which having a plurality of LEDs arranged side by side in the left-right direction, may be adopted as the plurality of blinking parts. Further, the plurality of blinking parts may be configured by one light emitting device such as LED, fluorescent lamp and the like and a plurality of liquid crystal or PLZT devices that are arranged side by side in the left-right direction at an outer side of the light emitting device.

Further, the light source of the exposure unit is not limited to the LED and may be an EL (electro luminescence) device, a fluorescent member and the like.

In the above-described exemplary embodiment, the tension spring 500 has been exemplified as the urging members. However, the invention is not limited thereto. For example, a compression spring can be also adopted.

The interlocking mechanism is not limited to the above-described structure of the exemplary embodiment and can be appropriately changed. For example, the connection member 410 of the above-described exemplary embodiment may be pressed rearward against the urging force of the urging member at the time of closing of the cover by a pressing member that is moved forward in conjunction with the opening operation of the cover and is moved rearward in conjunction with the closing operation of the cover. Incidentally, the pressing member may be such configured that it is connected to the rotation axis of the cover via a gear and is thus moved forward and rearward.

In the above-described exemplary embodiment, the invention has been applied to the color printer 1. However, the invention is not limited thereto. For example, the invention may be applied to the other image forming apparatuses, for example, a copier, a multi-function device and the like.

What is claimed is:

1. An image forming apparatus comprising:

a body frame having an opening;

a cover provided to the body frame and configured to swing between an open position at which the opening is opened and a close position at which the opening is closed;

an exposure unit comprising a plurality of blinking parts and configured to expose a photosensitive member, wherein the exposure unit is rotatably supported to the cover and is configured to swing between an exposure position at which the exposure unit is able to expose the photosensitive member and a retreated position at which the exposure unit is folded towards the cover than at the exposure position;

an urging member configured to urge the exposure unit from the exposure position towards the retreated position; and an interlocking mechanism configured to:

swing the exposure unit from the retreated position to the exposure position against an urging force of the urging member in conjunction with the rotation of the cover when the cover is closed; and allow the exposure unit to swing from the exposure position to the retreated position by the urging force of the urging member in conjunction with the rotation of the cover when the cover is opened, wherein the urging member is provided at a tip of the cover.

2. The image forming apparatus according to claim 1, wherein the cover comprises an abutting part configured to abut on the exposure unit or interlocking mechanism when the exposure unit is located at the retreated position, and wherein the urging member is configured to be deformed at a state where the exposure unit or interlocking mechanism abuts on the abutting part.

3. The image forming apparatus according to claim 1, wherein the urging member is a tension spring.

4. The image forming apparatus according to claim 1, wherein the exposure unit is configured to be rotatable with respect to the cover around a rotation axis and comprises the plurality of blinking parts at a first part thereof, wherein the interlocking mechanism comprises:

a connection member that is configured to move along the cover and is rotatably connected to a second part, which is located across the rotation axis from the first part, of the exposure unit;

a rotating member that is configured to be rotatable with respect to the cover around a rotating center and comprises a first portion deviating from the rotating center and connected to the connection member; and a moving member that is configured to move along the cover and is configured to press a second portion of the rotating member deviating from the rotation center, and wherein the moving member is configured to move in conjunction with an opening/closing operation of the cover.

5. The image forming apparatus according to claim 4, wherein the moving member comprises:

a support surface following a moving direction of the moving member; and a pressing surface that is inclined relative to the support surface, and wherein the moving member is configured to:

press the second portion by the pressing surface when the cover is gradually closed from the open position; and support the second portion by the support surface so as to restrain the moving of the second portion by the urging force when the cover is located at the close position.

6. The image forming apparatus according to claim 5, wherein the urging member is a tension spring.

7. The image forming apparatus according to claim 4, wherein the moving member is configured to move in a first direction and to press the second portion of the rotating member, wherein upon the second portion of the rotating member being pressed in the first direction, the rotating member is configured to rotate so as to move the connection member in a second direction that is opposite to the first direction, wherein upon the connection member moving in the second direction, the second part of the exposure unit is configured to move in the second direction together with the connection member, wherein the exposure unit is configured to swing around the rotation axis so as to swing between the exposure position and the retreated position by moving the second part of the exposure unit, and wherein upon the second part of the exposure unit moving in the second direction, the exposure unit is configured to swing to the exposure unit from the retreated position.

8. An image forming apparatus comprising:

a body frame having an opening;

a cover provided to the body frame and configured to swing between an open position at which the opening is opened and a close position at which the opening is closed;

an exposure unit comprising a plurality of blinking parts and configured to expose a photosensitive member, wherein the exposure unit is rotatably supported to the cover and is configured to swing between an exposure position at which the exposure unit is able to expose the photosensitive member and a retreated position at which the exposure unit is folded towards the cover than at the exposure position;

an urging member configured to urge the exposure unit from the exposure position towards the retreated position; and an interlocking mechanism configured to:

swing the exposure unit from the retreated position to the exposure position against an urging force of the urging member in conjunction with the rotation of the cover when the cover is closed; and allow the exposure unit to swing from the exposure position to the retreated position by the urging force of the urging member in conjunction with the rotation of the cover when the cover is opened, wherein the exposure unit is configured to be rotatable with respect to the cover around a rotation axis and comprises the plurality of blinking parts at a first part thereof, wherein the interlocking mechanism comprises:

a connection member that is configured to move along the cover and is rotatably connected to a second part, which is located across the rotation axis from the first part, of the exposure unit;

a rotating member that is configured to be rotatable with respect to the cover around a rotating center and comprises a first portion deviating from the rotating center and connected to the connection member; and a moving member that is configured to move along the cover and is configured to press a second portion of the rotating member deviating from the rotation center, and wherein the moving member is configured to move in conjunction with an opening/closing operation of the cover.

9. The image forming apparatus according to claim 8, wherein the moving member comprises:

a support surface following a moving direction of the moving member; and a pressing surface that is inclined relative to the support surface, and wherein the moving member is configured to:

press the second portion by the pressing surface when the cover is gradually closed from the open position; and support the second portion by the support surface so as to restrain the moving of the second portion by the urging force when the cover is located at the close position.

10. The image forming apparatus according to claim 9, wherein the urging member is a tension spring.

11. The image forming apparatus according to claim 10, wherein the moving member is configured to move towards a tip of the cover in conjunction with the closing operation of the cover, and wherein the urging member is provided at the tip of the cover.

12. The image forming apparatus according to claim 1, further comprising:

a plurality of the exposure units.

13. The image forming apparatus according to claim 8, wherein the moving member is configured to move in a first direction and to press the second portion of the rotating member, wherein upon the second portion of the rotating member being pressed in the first direction, the rotating member is configured to rotate so as to move the connection member in a second direction that is opposite to the first direction, wherein upon the connection member moving in the second direction, the second part of the exposure unit is configured to move in the second direction together with the connection member, wherein the exposure unit is configured to swing around the rotation axis so as to swing between the exposure position and the retreated position by moving the second part of the exposure unit, and wherein upon the second part of the exposure unit moving in the second direction, the exposure unit is configured to swing to the exposure unit from the retreated position.

14. The image forming apparatus according to claim 2, wherein the urging member has a first length that is longer than a natural length at the state where the exposure unit or interlocking mechanism abuts on the abutting part.

15. The image forming apparatus according to claim 14, wherein the urging member has a second length that is longer than the first length at a state where the exposure unit is in the exposure position.

16. An image forming apparatus comprising:

a body frame having an opening;

a cover provided to the body frame and configured to swing between an open position at which the opening is opened and a close position at which the opening is closed;

an exposure unit comprising a plurality of blinking parts and configured to expose a photosensitive member, wherein the exposure unit is rotatably supported to the cover and is configured to swing between an exposure position at which the exposure unit is able to expose the photosensitive member and a retreated position at which the exposure unit is folded towards the cover than at the exposure position;

an urging member configured to urge the exposure unit from the exposure position towards the retreated position; and an interlocking mechanism configured to:

swing the exposure unit from the retreated position to the exposure position against an urging force of the urging member in conjunction with the rotation of the cover when the cover is closed; and allow the exposure unit to swing from the exposure position to the retreated position by the urging force of the urging member in conjunction with the rotation of the cover when the cover is opened, wherein the urging member is a tension spring.

17. The image forming apparatus according to claim 16, wherein the cover comprises an abutting part configured to abut on the exposure unit or interlocking mechanism when the exposure unit is located at the retreated position, and wherein the urging member is configured to be deformed at a state where the exposure unit or interlocking mechanism abuts on the abutting part.

18. The image forming apparatus according to claim 17, wherein the urging member has a first length that is longer than a natural length at the state where the exposure unit or interlocking mechanism abuts on the abutting part.

19. The image forming apparatus according to claim 18, wherein the urging member has a second length that is longer than the first length at a state where the exposure unit is in the exposure position.

20. The image forming apparatus according to claim 16, further comprising:

a plurality of the exposure units.

* * * * *